United States Patent [19]

Bloemacher et al.

[11] Patent Number: 5,009,841

[45] Date of Patent: Apr. 23, 1991

[54] PROCESS FOR DEWAXING INJECTION MOLDED METAL PIECES AND FOR IMPROVING THE PROPERTIES THEREOF

[75] Inventors: Martin Bloemacher, Meckenheim; Reinhold Schlegel, Hassloch; Dieter Weinand, St. Martin, all of Fed. Rep. of Germany

[73] Assignee: BASF Aktiengesellschaft, Fed. Rep. of Germany

[21] Appl. No.: 508,190

[22] Filed: Apr. 12, 1990

[30] Foreign Application Priority Data

Apr. 14, 1989 [DE] Fed. Rep. of Germany ..... 3912298

[51] Int. Cl.[5] ..... B22F 100

[52] U.S. Cl. ..... 419/23; 419/33; 419/36; 419/37

[58] Field of Search ..... 419/36, 37, 23, 33

[56] References Cited

U.S. PATENT DOCUMENTS

| | | | |
|---|---|---|---|
| 3,989,518 | 11/1976 | Rueckl | 65/211 |
| 4,113,480 | 9/1978 | Rivers | 75/214 |
| 4,197,118 | 4/1980 | Wiech, Jr. | 75/228 |
| 4,404,166 | 9/1983 | Wiech, Jr. | 419/36 |
| 4,431,449 | 2/1984 | Dillon et al. | 75/246 |
| 4,604,259 | 8/1986 | Whitman | 75/247 |

FOREIGN PATENT DOCUMENTS

| | | |
|---|---|---|
| 3120501 | 9/1982 | Fed. Rep. of Germany . |
| 779242 | 7/1957 | United Kingdom . |
| 808583 | 2/1959 | United Kingdom . |

*Primary Examiner*—Brooks H. Hunt
*Assistant Examiner*—Leon Nigohosian, Jr.
*Attorney, Agent, or Firm*—Keil & Weinkauf

[57] ABSTRACT

A process for dewaxing injection molded metal pieces consisting of a metal/binder mixture, wherein a metal oxide is added to the metal/binder mixture.

5 Claims, No Drawings

PROCESS FOR DEWAXING INJECTION MOLDED METAL PIECES AND FOR IMPROVING THE PROPERTIES THEREOF

The present invention relates to a process for dewaxing injection molded metal pieces comprising a metal/-binder mixture (metal injection molding).

Metal injection molding (MIM) makes it possible to produce very small pieces of complicated shapes such as can be manufactured by classical molding and sintering techniques only with after-treatment.

Alloys frequently used for MIM are Fe, Fe-Ni, Fe-P and stainless steel.

Basic work relating to this process is described in U.S. Pat. Nos. 4,197,118 and 4,113,480.

The technique involves mixing finely divided metal powders —frequently carbonyl iron powder and mixtures thereof with other powdered alloys —with a binder and shaping the mixture by injection molding methods. The resulting injection molded piece is sintered to give ultimate densities of about 94%.

The purpose of the binder is to impart the necessary viscosity to the mixture to make it injection moldable and to hold the molded piece together. The subsequent removal of the binder is a factor which influences both the rate of production and the quality of the product.

The binders used are frequently multi-component systems based on low molecular weight thermoplastics, waxes, resins and special additives, but use is also made of water-soluble binders based on cellulose.

The binder system used primarily depends on the particle size and morphology of the powder. The proportion of binder in the final mixture is from about 7% to 20%, by weight (U.S. Pat. No. 3,989,518 and GB 808,583).

Thermoplastic binders are being used to an increasing extent, in which respect polyethylene and its low molecular weight waxes are particularly significant.

The binder may be removed in several ways. For example, the GB 779,242, U.S. Pat. No. 3,989,518 and U.S. Pat. No. 4,431,449 patent specifications describe thermal decomposition of various binders.

Alternatively, the binder may be extracted by dissolution in a variety of solvents (U.S. Pat. No. 4,197,118, U.S. Pat. No. 4,431,449 patent specifications describe 3,120,501).

Here again, the use of the cheaper and technologically more readily controllable technique of thermal decomposition has become the prevailing practice.

The time required for the dewaxing process may vary considerably and be as long as several days.

Such long dewaxing times have been necessary in order to avoid over-rapid heating of the molded piece and thus to prevent an excessively sharp rise in its internal pressure resulting from liquefaction and evaporation of the thermoplastic binder. Dewaxing, when carried out too quickly, can thus lead to severe deformation of the injection molded piece and to the formation of cracks and blisters therein.

At present, considerable effort is being put into reducing the dewaxing time in order to improve the MIM process.

Thus it is an object of the present invention to reduce the requisite dewaxing time by altering the metal/-binder mixture and to improve the density of the resulting sintered molded piece.

The present invention chiefly relates to the metal portion of the metal/binder mixture. A useful binder is a four-component plastics mixture (a long-chain polyethylene and three polyethlyene waxes having different melting points), but other binder systems may be used, for example a binder based on polystyrene or polypropylene.

Surprisingly, the addition of iron oxide not only facilitates dewaxing but also lowers the carbon content in the metal. When carrying out the process of the invention, it is advantageous to use very pure iron for the metal portion of the metal/binder mixture and a very pure iron oxide.

Preferably, the iron oxide used is one obtained by the carbonyl process, in which iron pentacarbonyl [$Fe(CO)_5$ ]is burnt in excess oxygen. This produces a very finely divided iron oxide (5 to 80 nm) having a large specific surface area ranging from 5 to 120 $m^2/g$.

It is advantageous to effect extremely thorough mixing of the oxide with the metal so as to cause intimate attachment of these components to each other. This is preferably achieved by grinding them in a rotating or vibrating mill containing grinding aids.

The amount of oxide added to the metal is from 2 to 30% and preferably from 4 to 10%, by weight.

The surface area of the oxide is from 10 to 120 $m^2/g$ and preferably from 70 to 110 $m^2/g$.

We have found that the removal of the thermoplastic binder from our metal/oxide/binder mixture requires significantly less time. Thus pieces prepared from a metal/binder mixture containing no oxide show blisters and cracks after heat treatment over 36 hours, whilst pieces prepared from our metal/oxide/binder mixture containing from 4 to 10% by weight of ground carbonyl iron oxide reveal no blisters or cracks after heat treatment requiring only about 14 hours.

Moreover, the effectiveness of the heat treatment increases with increasing oxide content, up to a certain limit.

The carbonyl iron powder OM manufactured by BASF and used as the metal component has a carbon content of about 0.9%. A piece prepared without oxide and dewaxed over a period of 36 hours has a carbon content of 1.2%, which points to a residual content of binder. In pieces containing about 5% w/w of carbonyl iron oxide, the carbon content falls to 1%, after only 14 hours of heat treatment.

The surface area of the oxide is also a factor influencing the extent to which the binder is removed.

The surface area has a particularly marked effect on the density of the sintered piece, which rises with increasing surface area of the oxide.

A carbonyl iron oxide having a surface area of 110 $m^2/g$ gives outstanding results, since the use thereof leads to sintered pieces requiring the shortest dewaxing times and having the highest densities recorded.

EXAMPLES

The mixtures required for the injection molding process were prepared as follows:

Metal/binder mixture

Commercial carbonyl iron oxide powder OM manufactured by BASF was fed to a 4 liter Sigma mixer whilst running. The mixer's heater maintained a temperature of 170° C. The premixed binder system comprising the four plastics materials stated above was then slowly metered to the carbonyl iron powder.

Mixing was continued for 20 minutes from the (accurately reproducible) point at which the composition assumed a pasty consistency, after which the mixture was removed from the mixer whilst still hot.

After cooling, the composition was broken up into lumps which could then be converted into granules in a granulating machine. These granules were then processed in a conventional injection molding machine to form small round pieces having a diameter of about 12 mm and a thickness of 2 mm.

Metal/oxide/binder mixture

Mixing in the Sigma mixer and injection molding were carried out in the same manner as described above for the metal/binder mixture. Prior to the mixing operation, the metal powder was ground in a 200 liter mill together with the carbonyl iron oxide. The mill was charged with 60 kg of said products and 200 kg of grinding aids (Cylpebs) and ran at 15 rps.

Example 1

Pieces prepared from the metal/binder mixture were heated under nitrogen from ambient temperature to about 480°, C., the temperature gradient being linear and the final temperature being maintained for 1 hour. The oven was coninuously purged with 120 1/h of nitrogen.

The binder content was 8% w/w.

| | |
|---|---|
| (a) Heating rate | approx. 32° C./h |
| Loss of weight | approx. 6% |
| Carbon content | approx. 1.2% |
| (b) Heating rate | approx. 13° C./h |
| Loss of weight | approx. 8% |
| Carbon content | approx. 1.2%. |

All pieces were cracked and blistered and some showed marked deformation.

The sintering operation was the same in all tests. The pieces were heated to 900° C. in an atmosphere of hydrogen and kept at this temperature for 15 minutes. They were then heated to 1,200° C. and kept at this temperature for 4 hours. The oven was then allowed to cool to ambient temperature.

The pieces prepared as described in Example 1 attained a maximum density of about 7.2 g/cm$^3$..

Example 2

5% w/w of the said carbonyl iron oxide having a surface area of 110 m$^2$/g were ground with the carbonyl iron powder as described above and then further processed in the manner described. The resulting pieces were also tempered under nitrogen.

| | |
|---|---|
| (a) Heating rate | approx. 32° C./h |
| Loss of weight | approx. 7% |
| Carbon content | approx. 1% |

None of the pieces showed cracks or blisters. The dewaxed pieces were easier to handle.

The maximum density measured on the sintered pieces was approx. 7.6 g/cm $^3$.

We claim:

1. A process for preparing injection molded metal pieces, which process comprises: mixing finely divided iron and from 2 to 30% by weight of a finely divided oxide of iron to produce a iron/iron oxide mixture; adding an organic binder with heating to the iron/iron oxide mixture to produce a iron/iron oxide binding mixture having a pasty consistency; cooling and granulating the iron/iron oxide/binder mixture to produce granules of the iron/iron oxide/binder; subjecting the granules to injection molding to form molded pieces of the iron/iron oxide/binder mixture; and heating the molded pieces under a reducing atmosphere to produce a molded piece containing iron free of iron oxide and free of binder.

2. The process of claim 1 wherein the binder contains low molecular weight polyethylene wax.

3. A process of claim 2, wherein the iron oxide has a virtually spherical particle shape and has been prepared by burning iron carbonyl.

4. A process of claim 2, wherein the iron oxide has a specific surface area of from 10 to 120 m$^2$/g.

5. A process of claim 2, wherein the iron oxide is strongly attached to the metal particles.

* * * * *